United States Patent [19]

Mauldin et al.

[11] Patent Number: 4,715,361

[45] Date of Patent: Dec. 29, 1987

[54] PASSIVE MOBILIZER

[76] Inventors: Donald M. Mauldin; Richard E. Jones, III, both of 3D Orthopedic, Inc., 11126 Shady Trail, Ste. #107, Dallas, Tex. 75229

[21] Appl. No.: 908,941

[22] Filed: Sep. 16, 1986

Related U.S. Application Data

[63] Continuation of Ser. No. 625,613, Jun. 28, 1984, abandoned.

[51] Int. Cl.[4] ..... A61H 1/02

[52] U.S. Cl. ..... 128/52; 104/99; 104/103; 128/33

[58] Field of Search ..... 128/25 R, 33, 44, 52, 128/56; 104/99, 103; 272/80

[56] References Cited

U.S. PATENT DOCUMENTS

| | | | |
|---|---|---|---|
| 242,754 | 6/1881 | Cole | 104/103 |
| 896,499 | 8/1908 | Witthoefft | 104/99 |
| 1,447,167 | 3/1923 | Bee | 104/103 |
| 2,135,018 | 11/1938 | Svensson | 272/80 |
| 3,612,042 | 10/1971 | Fry | 128/25 R |
| 3,672,357 | 6/1972 | Ferguson | 128/44 |
| 3,894,534 | 7/1975 | Graves | 128/25 R |

FOREIGN PATENT DOCUMENTS

| | | | |
|---|---|---|---|
| 99208 | 9/1898 | Fed. Rep. of Germany | 128/56 |
| 2407710 | 7/1979 | France | 128/52 |

OTHER PUBLICATIONS

Sutter, Biomedical, Inc.-Sutter CPM Device (Product Advertising Data) 1982.

Danniger Medical Technology, Inc.-Kinaflex Model 100 (Product Advertising Data).

Joint Mobilizer Systems, Inc.-The Knee-Hip Mobilizer; Ankle Mobilizer-(Product Advertising Data).

*Primary Examiner*—Clyde I. Coughenour

*Attorney, Agent, or Firm*—Jerry W. Mills; Alan W. Lintel

[57] ABSTRACT

Apparatus for passively exercising the human extremities includes an elongate track (16) comprising a tubular housing (46) having a slot formed in the bottom thereof. A lead screw (62) is longitudinally disposed in the housing and a carriage (26) is threadably engaged with the lead screw (62). The carriage (26) is connected to the extremity to be exercised, so that upon movement of the carriage (26) back and forth along the elongated track (16) the extremity is moved through a pre-determined range of motion. Stop members (28) are positionable on the housing in the path of movement of the carriage (26). Engagement of the carriage (26) with the stop member (28) effects longitudinal shifting of the lead screw (62). Longitudinal shifting of the lead screw (62) actuates switches (110) which reverse the direction of rotation of the lead screw (62) thereby reversing the direction of movement of the carriage (26).

27 Claims, 7 Drawing Figures

PASSIVE MOBILIZER

This application is a continuation of co-pending application Ser. No. 625,613, filed on June 28, 1984 now abandoned.

TECHNICAL FIELD

This invention relates generally to controlled passive mobilization of the human extremities, and more particularly to a system for effecting post-operative and post-trauma physical therapy.

BACKGROUND AND SUMMARY OF THE INVENTION

Post-operative and post-trauma physical therapy of the human hip, knee, shoulder and back is frequently facilitated by effecting motion of the extremities of the patient under circumstances that do not require the use of the patient's muscles. As will perhaps be apparent, therapy of this type, often referred to as passive mobilization, must be carried out under very controlled circumstances. Thus, range and speed of motion as well as the elevation and the angular relationship of the extremity being moved to the remainder of the patient's body must be carefully regulated in order to provide the desired results.

Various types of apparatus for providing passive mobilization have been provided heretofore. Most of the prior passive mobilization systems have been designed to be mounted directly on the hospital bed. This leads to difficulties in providing proper nursing care for the patient as well as difficulties for the patient in getting in and out of bed. Moreover, many of the prior passive mobilization devices have been comprised of a large number of unduly complicated parts and have therefore been expensive to purchase and use.

The present invention comprises a passive mobilization apparatus which overcomes the foregoing and other difficulties long since associated with the prior art. In accordance with the broader aspects of the invention, a passive mobilization system is supported above the hospital bed so that it does not interfere either with nursing care of the patient or with patient movement. The passive mobilization apparatus of the present invention is adapted to be manufactured from a relatively small number of uncomplicated parts, and is therefore inexpensive to purchase and use when compared with prior passive mobilization devices. Perhaps more importantly, the passive mobilization apparatus of the present invention provides complete control over the speed and range of the motion that is applied to the extremity being treated, over the elevation of the extremity, and over the angular relationship of the extremity to the remainder of the patient's body, and in this manner provides more effective therapy than has been possible in the use of many of the prior passive mobilization devices.

In accordance with more specific aspects of the invention, a passive mobilization apparatus constructed in accordance herewith includes an elongate track positioned above the hospital bed. A lead screw extends through the elongate track and a carriage is threadably engaged with the lead screw for movement thereby back and forth along the track. Stop members are positionable on the elongate track in the path of movement of the carriage. Upon engagement of the carriage with the stop members the direction of rotation of the lead screw and therefore the direction of movement of the carriage is reversed.

DESCRIPTION OF DRAWINGS

A more complete understanding of the invention can be had by reference to the following Detailed Description when taken in conjunction with the accompanying Drawings.

DETAILED DESCRIPTION

Figure 1:
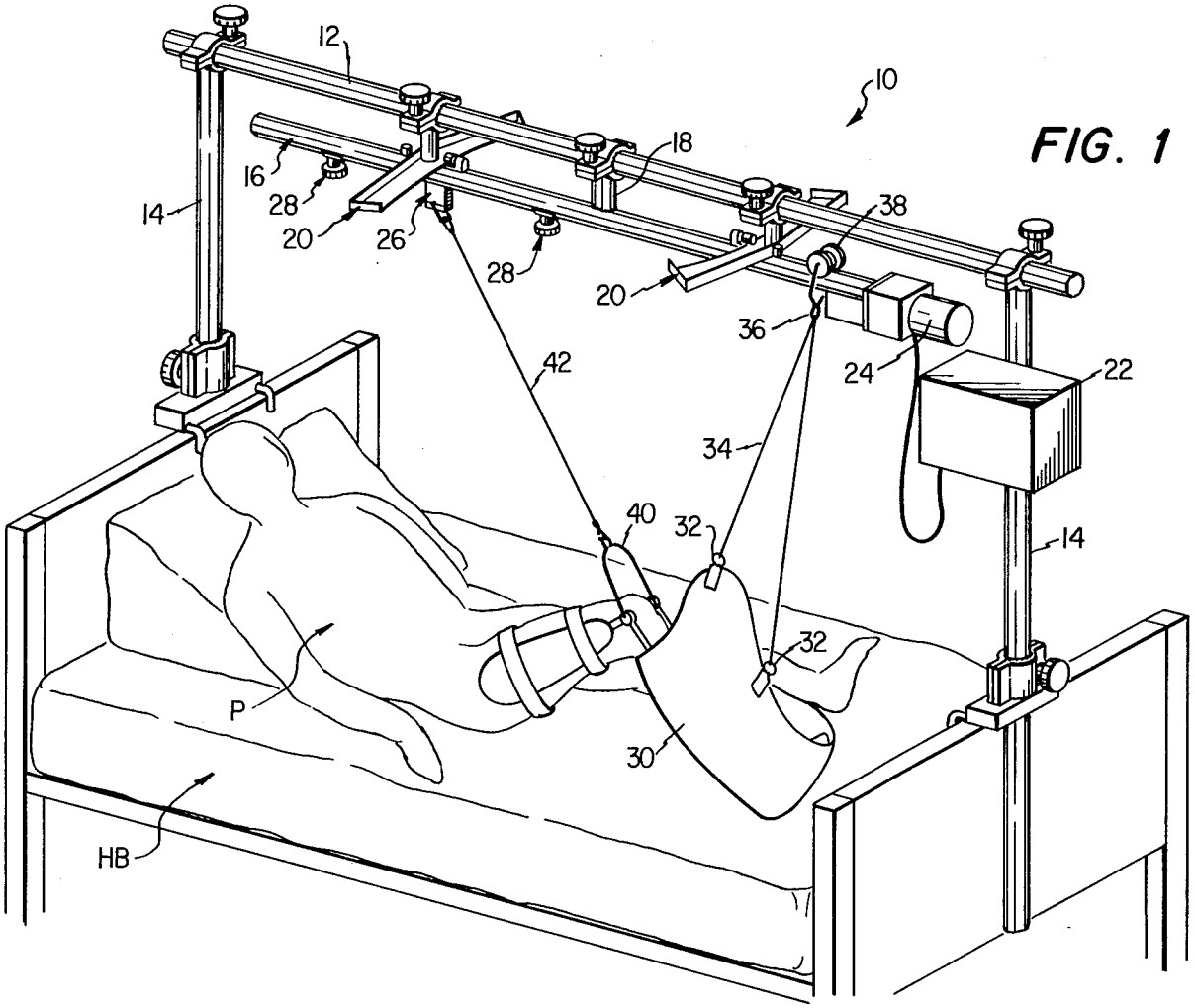
FIG. 1 is a perspective view of a passive mobilizer incorporating the invention.

Referring now to the drawings and particularly to FIG. 1 thereof, there is shown a passive mobilization system 10 incorporating the present invention. The passive mobilization system 10 is supported above a hospital bed HB having a patient P reclining thereon. A bar 12 extends longitudinally above the hospital bed HB and is normally substantially aligned with the center thereof. A pair of uprights 14 are secured to the frame of the hospital bed HB and in turn support the bar 12 in a generally horizontal orientation.

An elongate track 16 is supported from the bar 12 above the patient P. The elongate track 16 is supported from the bar 12 by a swivel post 18 and a pair of swing members 20. The swing members 20 support the elongate track 16 for pivotal movement in a horizontal plane about an axis defined by the swivel post 18. In this manner the angular relationship between the elongate track 16 and the patient P is selectively controlled.

A power supply 22 is mounted on one of the uprights 14. The power supply 22 supplies operating power to a drive motor 24 mounted at one end of the elongate track 16. The drive motor 24 is of the type that is operable at any desired speed in either direction. The motor 24 functions to drive a lead screw (not shown in FIG. 1) which extends longitudinally through the elongate track 16.

A carriage 26 is threadably engaged with the lead screw for movement thereby back and forth along the elongate track 16. A pair of stop members 28 are selectively positionable on the elongate track 16 in the path of movement of the carriage 26. Upon engagement of the carriage 26 with one of the stop members 28 the direction of operation of the motor 24 and therefore the direction of rotation of the lead screw is reversed. This causes the carriage 26 to move in the opposite direction until it engages the other stop member 28, where upon the direction of operation of the motor 24 is re-reversed.

In the use of the passive mobilization system 10 the patient P reclines on the hospital bed HB. The extremity of the patient P to be exercised is supported from the elongate track 16 by means of a sling 30. The sling 30 is provided with connection rings 32 which receive an elongate flexible member 34 which may comprise a nylon cord, etc. The elongate flexible member 34 is supported from a pully 36 which is in turn supported from a roller 38 supported on the elongate track 16. The angular relationship of the extremity to be exercised with respect to the remainder of the body of the patient P is controlled by selectively positioning the elongate track 16 on the swing members 20. The elevation of the extremity to be exercised is controlled by adjusting the length of the elongate flexible members 34.

In many instances, the extremity to be exercised will be provided with a brace. For example, the knee and elbow braces disclosed in U.S. Pat. No. 4;433,679 granted to Donald M. Mauldin and Richard Edward Jones, III on Feb. 28, 1984, may be utilized in the practice of the invention. In such instances a bow 40 is connected to the brace, and is in turn connected to the carriage 26 by an elongate flexible member 42. The elongate flexible member 42 may comprise a length of nylon cord, etc.

With the extremity to be exercised thus supported by and connected to the component parts of the passive mobilization system 10, the power supply 22 and the drive motor 24 are actuated to effect movement of the carriage 26 back and forth along the elognate track 16 at a predetermined rate of speed and within the limits of travel defined by the positioning of the stop members 28. As the carriage 26 moves back and forth along the elongate track 16 the extremity of the patient P is exercised without requiring the use of the muscles of the patient P. It will be understood that in the practice of the invention the angular relationship of the extreity being exercised and the elevation of the extremity being exercised are completely adjustable in accordance with particular requirements, as is the speed and range of exercise movement that is applied to the extremity by means of the elongate track 16 and the carriage 26.

Figure 2:
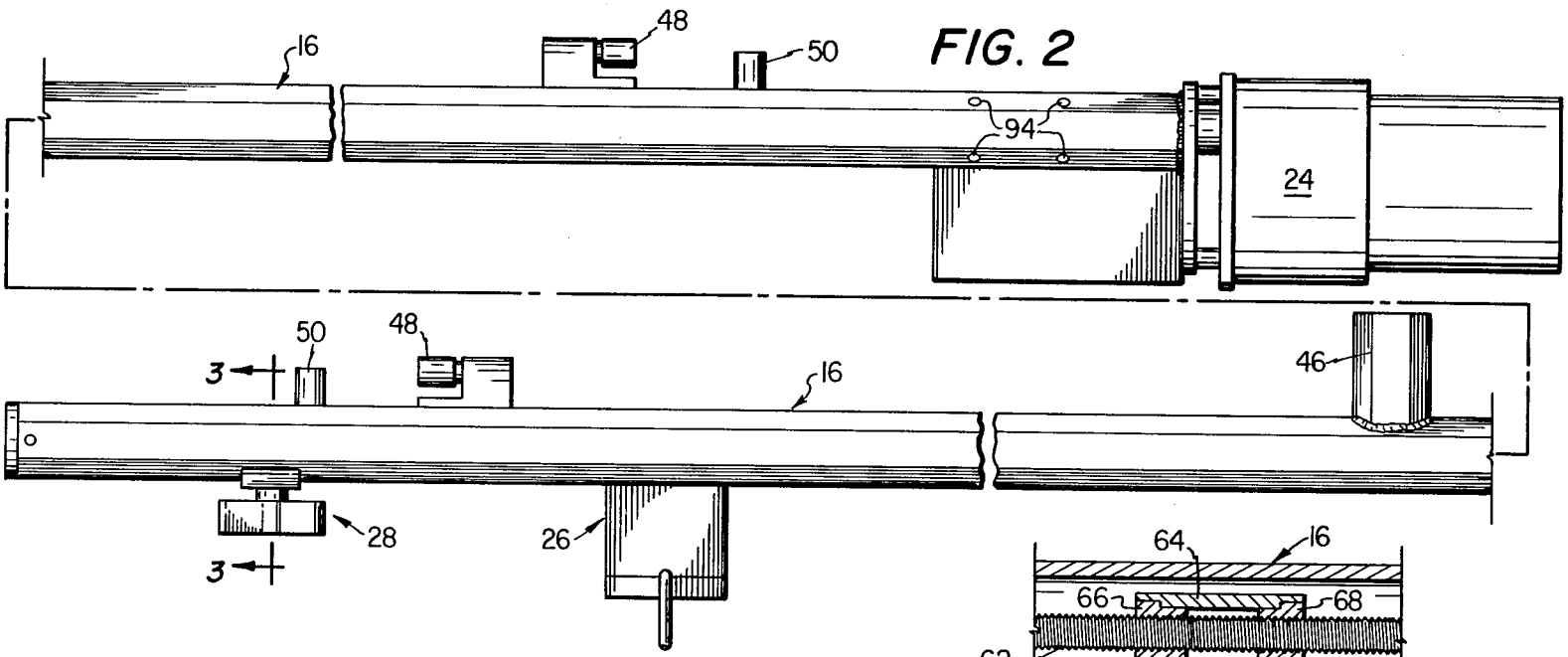
FIG. 2 is a side view of a portion of the passive mobilizer of FIG. 1.
Figure 3:
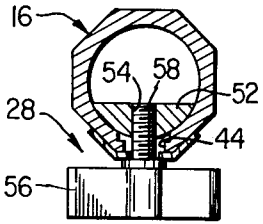
FIG. 3 is a sectional view taken generally along the line 3—3 in FIG. 2 in the direction of the arrows.

Referring now to FIGS. 2 and 3, the construction of the elongate track 16 is shown in greater detail. Although not critical to the practice of the invention, the exterior of the elongate track 16 may have an octangular configuration. The interior configuration of the elongate track 16 is preferably circular. A slot 44 is provided in the bottom of the elongate track 16 and extends the entire length thereof.

A tubular member 46 is secured to the elongate track 16 by welding and extends upwardly therefrom. The tubular member 46 comprises part of the swivel post 18 which is utilized to connect the elongate track 16 to the bar 12. Opposed horizontally disposed rollers 48 are positioned on opposite sides of the tubular member 46. The horizontally disposed rollers 48 cooperate with vertically disposed rollers 50 positioned adjacent thereto to secure the elongate track 16 in engagement with the swing members 20.

FIG. 3 further illustrates the construction of the stop members 28. Each stop member 28 includes a semi-circular shaped member 52 positioned within the elongate track 16 and having a threaded hole 54 formed therethrough. A knob 56 is positioned outside of the elongate track 16 and is provided with a threaded extension 58 which extends through the slot 44 into threaded engagement with the hole 54 of the member 52. Thus, upon rotation of the knob 56 in one direction, the component parts of the stop member 28 are loosened, thereby permitting sliding movement of the stop member 28 along the slot 44 of the elongate track 16 until the stop member 28 is suitably positioned. Thereafter the knob 56 is rotated in the opposite direction to secure the stop member 28 in place.

Figure 4:
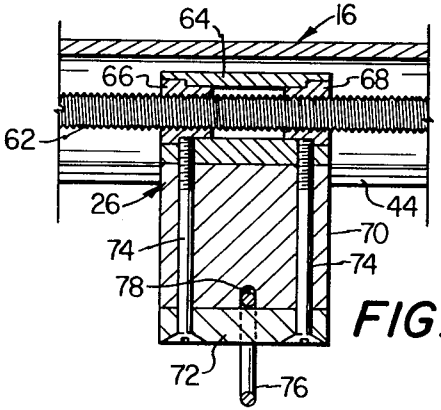
FIG. 4 is a partial longitudinal sectional view of the apparatus of FIG. 2.

Referring now to FIG. 4, a lead screw 62 is enclosed within the elongate track 16. The lead screw 62 extends longitudinally through the elongate track 16 in alignment with the slot 44. The lead screw 62 is rotatably supported within the elongate track 16 by suitable bearings (not shown).

The carriage 26 includes a traveler 64 positioned within the elongate track 16 and surrounding the lead screw 62. A pair of nuts 66 and 68 are mounted in the traveler 64 and are threadably engaged with the lead screw 62. Due to the threaded engagement between the lead screw 62 and the nuts 66 and 68, the carriage 26 moves longitudinally relative to the elongate track 16 responsive to rotation of the lead screw 62 under the action of the motor 24.

An extension 70 is secured to the traveler 64 and extends downwardly therefrom through the slot 44. An end cap 72 is secured to the bottom of the extension 70 by fasteners 74 which also serve to secure the extension 70 in engagement with the traveler 64. The end cap 72 serves to secure a rectangular ring 76 in a slot 78 formed in the bottom of the extension 70. In the practice of the invention, the rectangular ring 76 is utilized to secure the elongate flexible member 42 to the carriage 26.

Figure 5:
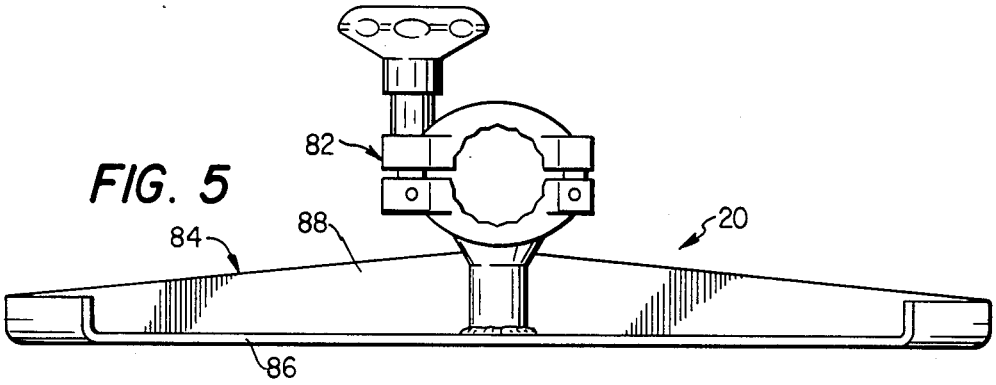
FIG. 5 is an end view of one of the swing members of the passive mobilizer of FIG. 1.
Figure 6:
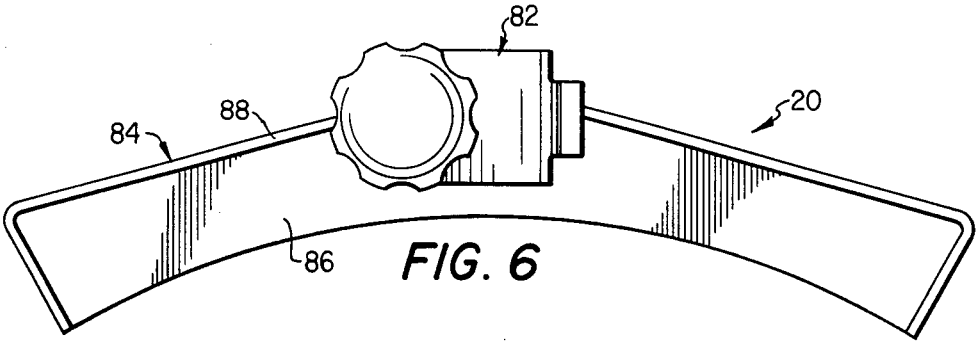
FIG. 6 is a top view of the swing member of FIG. 5.

The construction of the swing members 20 is illustrated in FIGS. 5 and 6. Each swing member 20 includes a clamp mechanism 82, whereby the swing member 20 is secured on the elongate track 16. Each swing member 20 comprises a track support member 84 having an L-shaped cross section and preferably formed from aluminum. The track support member 84 includes a horizontally disposed roller engaging plate 86 and a vertically disposed wall 88. In the use of the swing members 20, the clamps 82 are used to position the track support members 84 at suitable locations on the bar 12. The rollers 48 of the elongate track 16 engage the horizontally disposed plates 86 of the track support members 84 to support both the elongate track 16, the apparatus carried thereby, and the extremity of the patient P while permitting pivotal movement of the elongate track 16 about the vertical axis defined by the swivel post 18. The vertical wall 88 of one of the swing members 20 cooperates with the vertically disposed roller 50 on the elongate track 16 to prevent disengagement of the elongate track 16 from the swing member 20.

Figure 7:
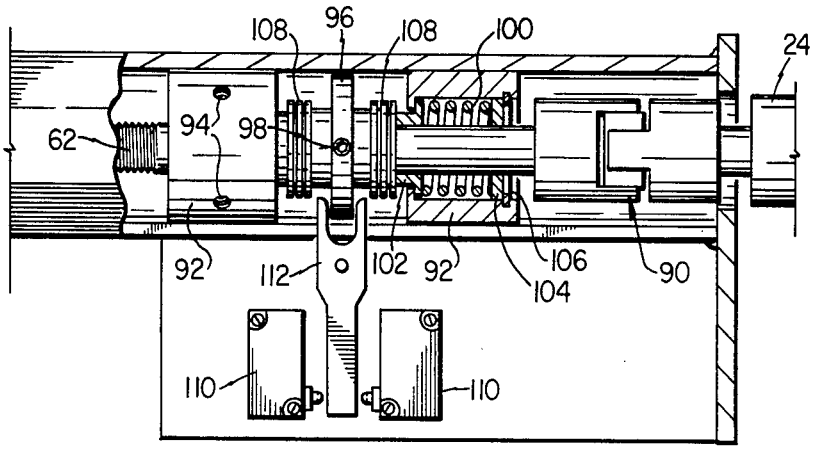
FIG. 7 is a partial longitudinal view of the apparatus of FIG. 2.

FIG. 7 illustrates the apparatus for connecting the lead screw 62 to the motor 24 and for reversing the direction of operation of the motor 24 and therefore the direction of rotation of the lead screw 62 and the direction of movement of the carriage 26 whenever the carriage 26 engages one of the stop members 28. A couple 90 connects the output of the drive motor 24 to the lead screw 62. The lead screw 62 extends from the coupler 90 through a pair of spring housings 92 which are secured in place along the elongate track 16 by means of fasteners 94. A switch actuator 95 is mounted on the lead screw 62 and is secured thereto by means of fasteners 94. A switch actuator 96 is mounted on the lead screw 62 and is secured thereto by means of fasteners 98. Thus, the switch actuator 96 rotates with the lead screw 62 under the action of the motor 24.

Each spring housing 92 encloses a compression spring 100. The spring 100 is compressed between a washer 102 and a washer 104 that is secured in place by a snap ring 106. Bearings 108 are provided between the washer 102 and the rotating switch actuator 96. A pair of limit switches 110 are positioned for selective actuation by a lever 112 which is in turn actuated by the switch actuator 96.

The coupler 90 permits limited axial movement of the lead screw 62 relative to the elongate track 16. The lead screw 62 is normally centered by the spring 100 which apply equal and opposite forces to the lead screw 62 through the washers 102, the bearings 108 and the switch actuator 96. Whenever the carriage 26 engages one of the stop member 28 further movement thereof along the elongate track 16 is prevented. This in turn causes axial movement of the lead screw 62 against the action of one of the springs 100. Axial movement of the lead screw 62 causes axial movement of the switch actuator 96 which pivots the lever 112 thereby activating one of the limit switches 110. Upon actuation by the switch actuator 96, the limit switches 110 function to reverse the direction of operation of the motor 24, thereby reversing the direction of rotation of the lead screw 62 which in turn reverses the direction of movement of the carriage 26.

From the foregoing it will be understood that the present invention comprises a passive mobilization apparatus incorporating numerous advantages over prior designs. The passive mobilization apparatus of the present invention is adapted for positioning entirely above a hospital bed, thereby facilitating both nursing care of the patient and patient movement. The passive mobilization apparatus of the present invention is adapted for construction from a small number of relatively uncomplicated parts so that the apparatus is inexpensive to purchase and use when compared with prior passive mobilization devices. Notwithstanding these advantages, the passive mobilization apparatus of the present invention affords complete control over the elevation and the angular relationship of the extremity to be exercised to the remainder of the patients body. Complete control over the range and speed of the exercise motion that are applied to the extremity to be exercised are provided by means of the present invention.

Although prefered embodiments of the present invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. Apparatus for exercising the human extremities about a joint which comprises:

an elongate track;

means for supporting the elongate track above the extremity to be exercised;

a carriage supported by the elongate track;

means for moving the carriage along the elongate track;

means for reversing the direction of movement of the carriage along the elongate track;

first support means for connecting the carriage to the extremity to be exercised whereby the extremity to be exercised is moved in response to the movement of the carriage along the elongate track and is allowed to rotate about an axis defined by the length of the extremity such that the joint rotates in an anatomically correct motion; and second support means connected to the extremity to be exercised and to the elongated track, said second support movable along the elongate track in response to movement of the extremity to be exercised.

2. The apparatus according to claim 1 wherein the extremity support means comprises a sling having one end of an elongate flexible member attached thereto, the other end of the elongate flexible member being movably mounted on the track.

3. The apparatus according to claim 2 further including a roller operable to allow movement of the end of the flexible member mounted on the track along the track in response to the movement of the supported extremity.

4. The apparatus according to claim 1 wherein the means for supporting the elongate track further comprises means for supporting the elongate track for pivotal movement in a substantially horizontally disposed plane.

5. The apparatus according to claim 4 wherein the means for supporting the elongate track comprises:

a horizontally disposed frame;

a pair of crescent shaped brackets;

means for supporting the crescent shaped brackets on the frame with the brackets disposed subtantially horizontally; and means for supporting the elongate track from the crescent shaped brackets for movement therealong, thereby facilitating pivotal movement of the elongate track with respect to the frame.

6. The apparatus according to claim 5 wherein the bracket support means is selectively positionable along the track.

7. The apparatus according to claim 1 wherein the means connecting the carriage to the extremity to be exercised includes brace means having the extremity received therein.

8. The apparatus according to claim 1 wherein the carriage movement limiting means comprises stop means selectively positionable along the track.

9. The apparatus according to claim 8 wherein the carriage reversing means comprises means operable to activate the drive means to reverse the direction of movement of the carriage along the track when the carriage engages the stop means.

10. The apparatus according to claim 9 wherein the drive means for moving the carriage along the elongate track comprises a lead screw, and wherein the carriage is radially engaged with the lead screw.

11. The apparatus according to claim 10 wherein the means responsive to engagement of the carriage with the stop means for reversing the direction of movement of the carriage comprises:

spring means for positioning the lead screw longitudinally and permitting longitudinal movement of the lead screw within a pre-determined range;

the engagement of the carriage with the stop means causing longitudinal movement of the lead screw against the action of the spring means; and means responsive to longitudinal movement of the lead screw for reversing the direction of rotation thereof and thereby reversing the direction of movement of the carriage.

12. The apparatus according to claim 11 further characterized by:

switch actuator means connected to the lead screw for longitudinal positioning thereby; and switch means positioned for actuation by the switch actuator means upon longitudinal movement of the lead screw.

13. Apparatus for exercising the human extremities having first and second portions connected by a joint which comprises:

an elongate track comprising a tubular housing having a lead screw extending longitudinally therein;

adjustable track support means supporting the track at a preselected angle relative to and above the patient extremity to be exercised;

a carriage including a portion within the housing in threaded engagement with the lead screw and first support means for connecting the carriage with the first portion of the extremity to be exercised, thereby causing the extremity to move in a preselected plane according to the angle at which the track is supported above the extremity in response to the movement of the carriage along the track, said means for connecting said carriage operable to allow rotational movement of the second portion of the extremity such that normal anatomical movement of the joint is achieved;

second support means connected to a second portion of the extremity to be exercised movable along the track in response to the movement of the extremity by the carriage;

means for rotating the lead screw in a first direction to move the carriage along the track;

stop means selectively positionable on the housing of the track in the path of movement of the carriage; and means responsive to engagement of the stop means by the carriage for reversing the direction of rotation of the lead screw thereby causing the carriage to move in the opposite direction along the track.

14. The apparatus according to claim 13 wherein the means for supporting the elongate track further comprises means for supporting the elongate track for pivotal movement in a substantially horizontally disposed plane.

15. The apparatus according to claim 13 wherein the means for supporting the elongate track comprises:

a horizontally disposed frame;

a pair of crescent shaped brackets;

means for supporting the crescent shaped brackets on the frame with the brackets disposed substantially horizontally; and means for supporting the elongate track from the crescent shaped brackets for movement therealong, thereby facilitating pivotal movement of the elongate track wtih respect to the frame.

16. The apparatus according to claim 15 wherein said bracket support means is selectively positionable along the track.

17. The apparatus according to claim 13 wherein the means responsive to engagement of the carriage with the stop means for reversing the direction of movement of the carriage comprises:

spring means for positioning the lead screw longitudinally and permitting longitudinal movement of the lead screw within a predetermined range;

the engagement of the carriage with the stop means causing longitudinal movement of the lead screw against the action of the spring means; and means responsive to longitudinal movement of the lead screw for reversing the direction of rotation thereof and thereby reversing the direction of movement of the carriage.

18. The apparatus according to claim 17 further characterized by:

switch actuator means connected to the lead screw for longitudinal positioning thereby; and switch means positioned for actuation by the switch actuator means upon longitudinal movement of the lead screw.

19. The apparatus according to claim 13 wherein the extremity support means comprises a sling having one end of an elongate flexible member attached thereto, the other end of said elongate flexible member being attached to said track.

20. The apparatus according to claim 13 wherein the means connecting the carriage to the extremity to be exercised includes brace means having the extremity received therein.

21. Apparatus for moving a carriage back and forth along a predetermined path which comprises:

an elongate track comprising a tubular housing having a slot formed in the bottom thereof;

a lead screw extending longitudinally through the housing above the slot thereof;

a carriage including an inside portion located within the housing and threadably engaged with the lead screw and an outside portion located without the housing and connected to the inside portion through the slot;

stop means selectively positionable on the housing in the path of movement of the carriage to define the limits of travel of the carriage along the longitudinally extending slot;

spring means for longitudinally positioning the lead screw and permitting longitudinal movement of the lead screw within a pre-determined range;

engagement of the carriage with the stop means causing longitudinal movement of the lead screw against the action of the spring means;

means for rotating the lead screw in a first direction and thereby effecting movement of the carriage in one direction along the elongated slot of the housing; and means resposive to longitudinal movement of the lead screw against the action of the lead screw against the action of the spring means for reversing the direction of rotation of the lead screw and thereby causing the carriage to move in the opposite direction along the elongated slot.

22. The apparatus according to claim 21 further characterized by:

switch actuator means connected to the lead screw for longitudinal positioning thereby; and switch means positioned for actuation by the switch actuator means upon longitudinal movement of the lead screw.

23. The apparatus according the claim 22 further including means connecting the carriage to an extremity of a patient and thereby exercising the extremity responsive to movement of the carriage back and forth along the longitudinally extending slot of the housing.

24. The apparatus according the claim 21 further comprising means for supporting the elongate track for pivotal movement in a substantially horizontally disposed plane.

25. The apparatus according to claim 24 wherein the means for supporting the elongate track comprises:

a horizontally disposed frame;

a pair of crescent shaped brackets;

means for supporting the crescent shaped brackets on the frame with the brackets disposed substantially horizontally; and means for supporting the elongate track from the crescent shaped brackets or movement therealong, thereby facilitating pivotal movement of the elongate track with respect to the frame.

26. Apparatus for exercising the human extremities which comprises:

an elongate track;

means for supporting the elongate track above the extremity to be exercised;

a carriage supported by the elongate track;

means for moving the carriage along the elongate track;

means for reversing the direction of movement of the carriage along the elongate track;

means on the track for supporting the extremity to be exercised;

means for connecting the carriage to the extremity to be exercised whereby the extremity to be exercised is moved in response to the movement of the carriage along the elongate track;

means for pivoting the elongate track with respect to the elongate track support means;

a swing member mounted to the elongate track support means;

means on said elongate track for securing the elongate track in engagement with the swing member during the pivoting of the elongate track comprising a horizontal roller on the elongate track engaging the swing member and a vertical roller, the swing member being secured between the horizontal roller and the vertical roller.

27. The apparatus according to claim 26 wherein the extremity support means includes means movable along the elongate track in response to movement of the carriage along the elongate track.

* * * * *